US011220410B2

(12) United States Patent
Miyagawa

(10) Patent No.: US 11,220,410 B2
(45) Date of Patent: Jan. 11, 2022

(54) SHEET SUCTION DEVICE, SHEET CONVEYING DEVICE INCORPORATING THE SHEET SUCTION DEVICE, PRINTER INCORPORATING THE SHEET CONVEYING DEVICE, AND SUCTION AREA SWITCHER

(71) Applicant: Hiroaki Miyagawa, Kanagawa (JP)

(72) Inventor: Hiroaki Miyagawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 182 days.

(21) Appl. No.: 16/511,123

(22) Filed: Jul. 15, 2019

(65) Prior Publication Data

US 2020/0039772 A1 Feb. 6, 2020

(30) Foreign Application Priority Data

Aug. 1, 2018 (JP) ..... JP2018-145468

(51) Int. Cl.
*B65H 5/22* (2006.01)
*B65H 7/16* (2006.01)
*B65H 7/02* (2006.01)

(52) U.S. Cl.
CPC ..... *B65H 5/222* (2013.01); *B65H 5/226* (2013.01); *B65H 7/02* (2013.01); *B65H 7/16* (2013.01); *B65H 2406/33* (2013.01); *B65H 2406/362* (2013.01)

(58) Field of Classification Search
CPC . B65H 5/22; B65H 5/222; B65H 7/02; B65H 2404/40; B65H 2406/30; B65H 2406/33; B65H 2406/331; B65H 2406/332; B65H 2406/36; B65H 2406/362; B65H 2406/3622
See application file for complete search history.

(56) References Cited

U.S. PATENT DOCUMENTS 8,201,819 B2 * 6/2012 Asari ..... B65H 7/16 271/108
9,796,546 B1 * 10/2017 LeFevre ..... B41J 11/007
2009/0243207 A1 * 10/2009 Fukui ..... B65H 27/00 271/264
2011/0101599 A1 * 5/2011 Hiramitsu ..... B65H 7/14 271/96
2015/0035228 A1 * 2/2015 Carmichael ..... B65C 3/08 271/276

FOREIGN PATENT DOCUMENTS

JP 2007-065436 3/2007
JP 2013-240997 12/2013
JP 2013-241272 12/2013

* cited by examiner

*Primary Examiner* — Prasad V Gokhale

(74) *Attorney, Agent, or Firm* — Harness, Dickey & Pierce, P.L.C.

(57) ABSTRACT

A sheet suction device includes a sheet carrier, a suction unit, and a rotary body. The sheet carrier has a carrying region. The carrying region includes a plurality of suction openings. The sheet carrier is configured to rotate while holding a sheet. The suction unit is configured to communicate with the plurality of suction openings and suck air via the plurality of suction openings. The rotary body is disposed between the plurality of suction openings and the suction unit. The rotary body is configured to rotate to change a number of suction openings that communicate with the suction unit, among the plurality of suction openings of the sheet carrier.

18 Claims, 20 Drawing Sheets

SHEET SUCTION DEVICE, SHEET CONVEYING DEVICE INCORPORATING THE SHEET SUCTION DEVICE, PRINTER INCORPORATING THE SHEET CONVEYING DEVICE, AND SUCTION AREA SWITCHER

CROSS-REFERENCE TO RELATED APPLICATION

This patent application is based on and claims priority pursuant to 35 U.S.C. § 119(a) to Japanese Patent Application No. 2018-145468, filed on Aug. 1, 2018, in the Japan Patent Office, the entire disclosure of which is hereby incorporated by reference herein.

BACKGROUND

Technical Field

This disclosure relates to a sheet suction device, a sheet conveying device incorporating the sheet suction device, a printer incorporating the sheet conveying device, and a suction area switcher.

Related Art

Various printers print a sheet held on a rotation member, for example, a drum while the sheet is being conveyed.

Sheet conveying devices are known to convey a sheet (sheet material) while conveying the sheet sucked by air and held sucking the sheet on a circumferential surface of a drum.

For example, a known sheet conveying device includes a sheet conveying body to suck a sheet by air and convey the sheet, three air suction areas, each having multiple air suction holes over an entire circumferential surface of a support face supporting and suctioning the entire sheet on the sheet conveying body, multiple air suction areas to divide each area into multiple areas, a switching portion mounted between the multiple air suction areas and a negative pressure source, to switch connection of the negative pressure source with each air suction area, and a controller to individually control air suction by the multiple air suction areas via the switcher based on a size of the sheet.

SUMMARY

At least one aspect of this disclosure provides a sheet suction device including a sheet carrier, a suction unit, and a rotary body. The sheet carrier has a carrying region. The carrying region includes a plurality of suction openings. The sheet carrier is configured to rotate while holding a sheet. The suction unit is configured to communicate with the plurality of suction openings of the sheet carrier and suck air via the plurality of suction openings. The rotary body is disposed between the plurality of suction openings and the suction unit. The rotary body is configured to rotate to change a number of suction openings that communicate with the suction unit, among the plurality of suction openings of the sheet carrier.

Further, at least one aspect of this disclosure provides a sheet conveying device including the above-described suction device. The sheet carrier included in the sheet suction device is configured to rotate to convey the sheet while the sheet carrier holds the sheet on the sheet carrier.

Further, at least one aspect of this disclosure provides a printer including the above-described sheet conveying device.

Further, at least one aspect of this disclosure provides a suction area switcher including a first rotary body having a groove that is disposed along a circumferential direction of the first rotary body, and a second rotary body having a plurality of openings configured to connect to a plurality of suction openings in a carrying region on a sheet carrier that is configured to rotate while holding a sheet on the sheet carrier. The plurality of suction openings is disposed along a circumferential direction of the sheet carrier. The first rotary body and the second rotary body are configured to be disposed between the sheet carrier and a suction unit configured to communicate with the plurality of suction openings and suck air via the plurality of suction openings of the sheet carrier. The first rotary body is configured to rotate relative to the second rotary body to change a number of the plurality of openings of the first rotary body to be connected to the plurality of grooves of the second rotary body. In response to a change of the number of the plurality of openings of the first rotary body, the number of one or more suction openings that communicate with the suction unit, among the plurality of suction openings of the sheet carrier, is changed.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
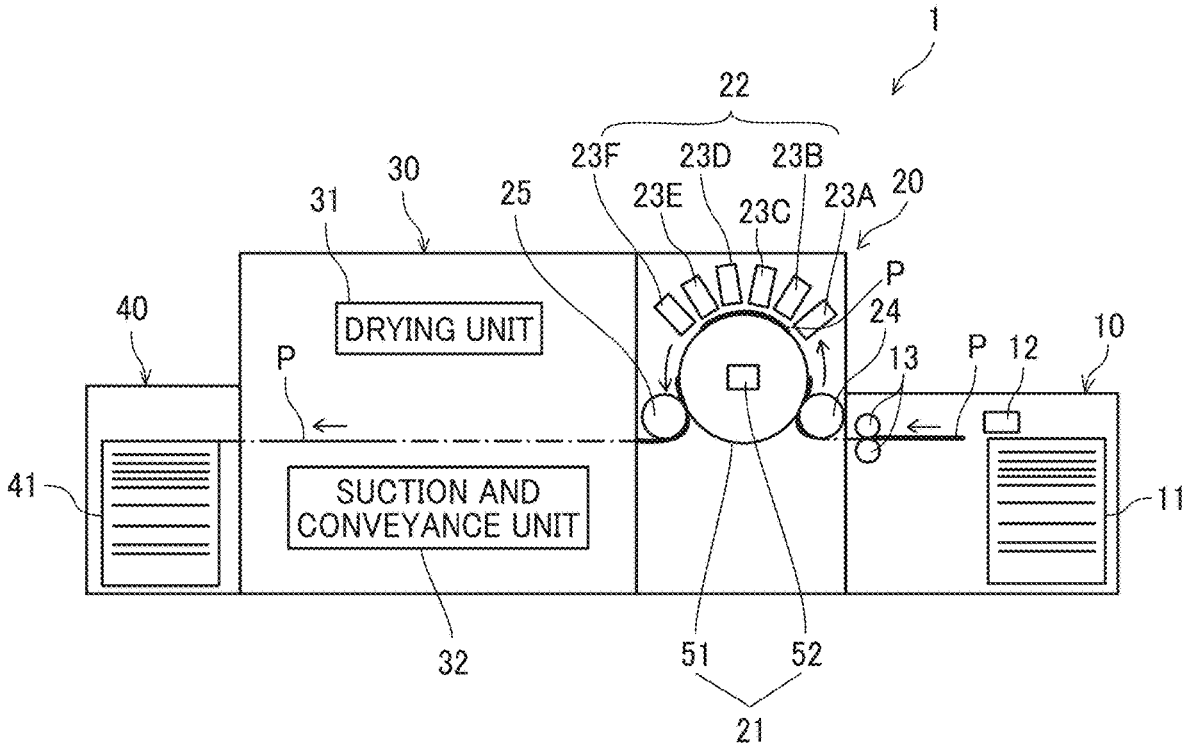
FIG. 1 is a schematic diagram illustrating a printer according to Embodiment 1 of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any sheet suction device, and is implemented in the most effective manner in any inkjet image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an embodiment applicable to a sheet suction device, a sheet conveying device, a printer, and a suction area switcher, with reference to the following figures.

It is to be noted that elements (for example, mechanical parts and components) having the same functions and shapes are denoted by the same reference numerals throughout the specification and redundant descriptions are omitted.

First, configurations according to Embodiment 1 of this disclosure are described with reference to FIGS. 1 and 2.

Figure 2:
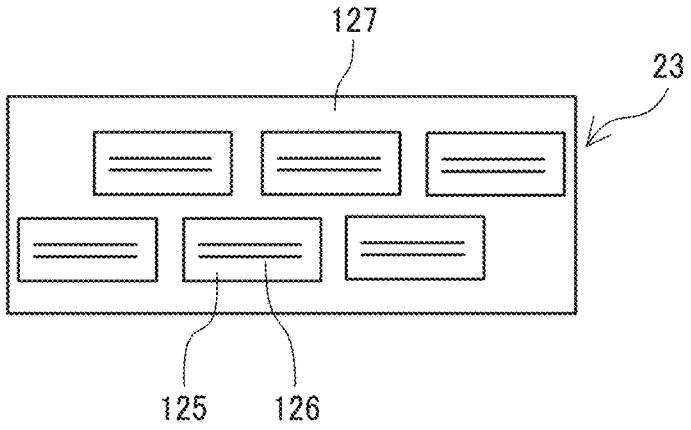
FIG. 2 is a plan view illustrating a liquid discharging unit of the printer of FIG. 1.

FIG. 1 is a schematic diagram illustrating a printer 1 according to Embodiment 1 of this disclosure, and FIG. 2 is a plan view illustrating a discharging unit of the printer 1 of FIG. 1.

It is to be noted in the following examples that: the term "printer" indicates an apparatus in which an image is printed on a recording medium such as paper, OHP (overhead projector) transparencies, OHP film sheet, thread, fiber, fabric, leather, metal, plastic, glass, wood, and/or ceramic by attracting developer or ink thereto, the term "image formation" indicates an action for providing (i.e., printing) not only an image having meanings such as texts and figures on a recording medium but also an image having no meaning such as patterns on a recording medium, and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

The printer 1 includes a loading device 10, a printing device 20, a drying device 30, and an ejection device 40. The printer 1 feeds a sheet P that is fed from the loading device 10, prints an image on the sheet P by applying liquid in the printing device 20, dries the liquid adhered on the sheet P in the drying device 30, and ejects the sheet P to the ejection device 40.

The loading device 10 includes a loading tray 11 on which a plurality of sheets P are stacked, a sheet feeding unit 12 to separate and feed the sheets P one by one from the loading tray 11, and a pair of registration rollers 13 to feed the sheets P to the printing device 20.

Any sheet feeding unit such as a device using a roller or a device using air suction may be used as the sheet feeding unit 12. After having been fed from the loading tray 11 by the sheet feeding unit 12, the leading end of the sheet P is delivered to the pair of registration rollers 13. Then, as the pair of registration rollers 13 is driven at a predetermined timing, the sheet P is conveyed to the printing device 20.

The printing device 20 includes a sheet conveying device 21 that conveys the sheet P. The sheet conveying device 21 includes a drum 51 that functions as a sheet carrier (rotation member) that holds the sheet P on the circumferential surface and rotates the sheet P, and a suction unit 52 that is an air suction unit that generates suction force on the circumferential surface of the drum 51 so as to perform air suction. The printing device 20 further includes a liquid discharging unit 22 that discharges liquid toward the sheet P held on the drum 51 of the sheet conveying device 21.

The printing device 20 further includes a transfer cylinder 24 and a delivery cylinder 25. The transfer cylinder 24 receives the sheet P fed from the loading device 10 and transfers the sheet P to the drum 51. The delivery cylinder 25 delivers the sheet P conveyed by the drum 51 to the drying device 30.

The leading end of the sheet P that has been conveyed from the loading device 10 to the printing device 20 is gripped by a gripping member (sheet gripper) that is provided on a surface of the transfer cylinder 24. With the leading end being gripped by the gripping member, the sheet P is conveyed in accordance with rotations of the transfer cylinder 24. The sheet P conveyed by the transfer cylinder 24 is delivered to the drum 51 at a position facing the drum 51.

A different gripping member (sheet gripper) is provided on the surface of the drum 51, and the leading end of the sheet P is gripped by the different gripping member (sheet gripper). Multiple suction holes are dispersedly formed on the surface of the drum 51. The suction unit 52 generates a suction airflow from a predetermined number of suction holes of the drum 51 toward an inside of the drum 51.

After having been transferred from the transfer cylinder 24 to the drum 51, the sheet P is gripped at the leading end by a sheet gripper 106 and is sucked to and held on the drum 51 due to suction airflow generated by the suction unit 52. Accordingly, the sheet P is conveyed along with rotations of the drum 51.

The liquid discharging unit 22 includes discharging units 23 (i.e., discharging units 23A to 23F). The discharging units 23 function as liquid discharging units. For example, in the present embodiment, the discharging unit 23A discharges liquid of cyan (C), the discharging unit 23B discharges liquid of magenta (M), the discharging unit 23C discharges liquid of yellow (Y), and the discharging unit 23D discharges liquid of black (K), respectively. Further, the discharging units 23E and 23F are used to discharge any one of YMCK or special liquid such as white and gold (silver). Further, the liquid discharging unit 22 may further include a discharging unit to discharge processing liquid such as surface coating liquid.

The discharging unit 23 is a full-line type head unit that includes a plurality of liquid discharge heads 125 arranged on a base 127. Hereinafter, the plurality of liquid discharging heads 125 are also referred to as the "plurality of heads 125". Each of the plurality of heads 125 includes one or more nozzle arrays 126 in which a plurality of nozzles are arranged, as illustrated in FIG. 2.

A discharging operation of each of the discharging units 23 of the liquid discharging unit 22 is controlled by drive signals corresponding to print information. When the sheet P carried by the drum 51 passes through a region facing the liquid discharging unit 22, the liquid of each color is discharged from the discharging units 23, and an image corresponding to the printing information is printed on the sheet P.

The drying device 30 includes a drying mechanism 31 to dry the liquid adhered to the sheet P by the printing device 20 and a suction and conveyance mechanism 32 to convey the sheet P while sucking the sheet P conveyed from the printing device 20.

After the sheet P conveyed from the printing device 20 has been received by the suction and conveyance mechanism 32, the sheet P is conveyed to pass through the drying mechanism 31 and then delivered to the ejection device 40.

When the sheet P passes through the drying mechanism 31, the liquid on the sheet P is subjected to a drying process. According to the drying process by the drying mechanism 31, moisture such as water in the liquid evaporates. Consequently, the colorant contained in the liquid is fixed to the sheet P, and curling of the sheet P is restrained.

The ejection device 40 includes a sheet ejection tray 41 on which a plurality of sheets P is stacked. The plurality of sheets P conveyed from the drying device 30 is sequentially stacked and held on the sheet ejection tray 41.

It is to be noted that the printer 1 may include a pre-processing device that performs pre-processing to the sheet P and dispose the pre-processing device upstream from the printing device 20 in the sheet conveying direction or include a post-processing device that performs post-processing to the sheet P on which liquid is adhered and dispose the post-processing device between the drying device 30 and the ejection device 40.

For example, the pre-processing device may perform a pre-application process that applies a process liquid on the sheet P before the image formation. The process liquid reacts with ink to reduce bleeding of the ink to the sheet P. Further, the post-processing device may perform a sheet reversing process and a binding process to bind a plurality of sheets P, for example. The sheet reversing process reverses the sheet P, on which image is printed by the printing device 20, and conveys the reversed sheet P to the printing device 20 again to print on both sides of the sheet P.

Further, the present embodiment provides an example in which the printing device includes liquid discharging units. However, any unit other than the liquid discharging units may be used for printing.

Figure 3:
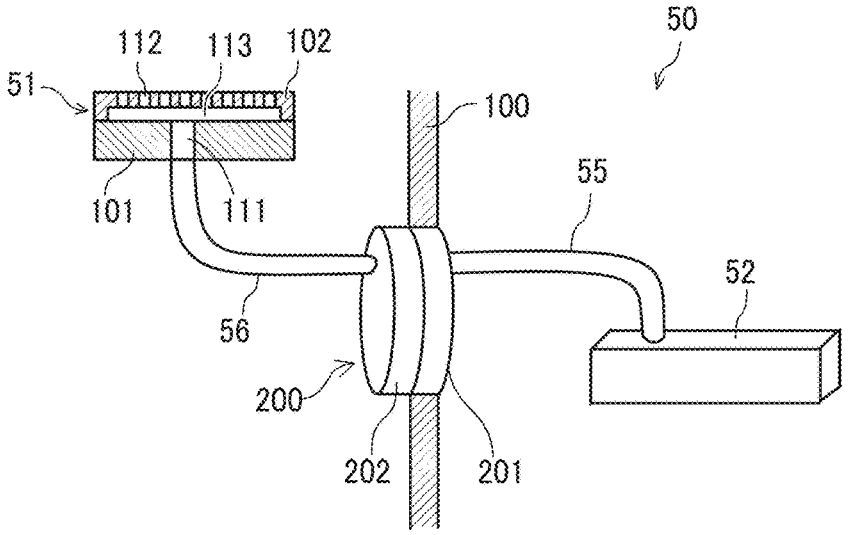
FIG. 3 is a diagram illustrating an entire configuration of a sheet suction device according to Embodiment 1 of this disclosure.

Next, a description is given of a sheet suction device according to Embodiment 1 of this disclosure, with reference to FIG. 3.

FIG. 3 is a diagram illustrating an entire configuration of a sheet suction device according to Embodiment 1 of this disclosure.

A sheet suction device 50 includes the drum 51, the suction unit 52, and a rotary valve 200 that functions as a suction area switcher disposed between the drum 51 and the suction unit 52. The suction unit 52 and the rotary valve 200 are connected by a hose (tube) 55, and the rotary valve 200 and the drum 51 are connected by a hose (tube) 56.

Next, a description is given of an example of the drum 51, with reference to FIGS. 4 through 7.

Figure 4:
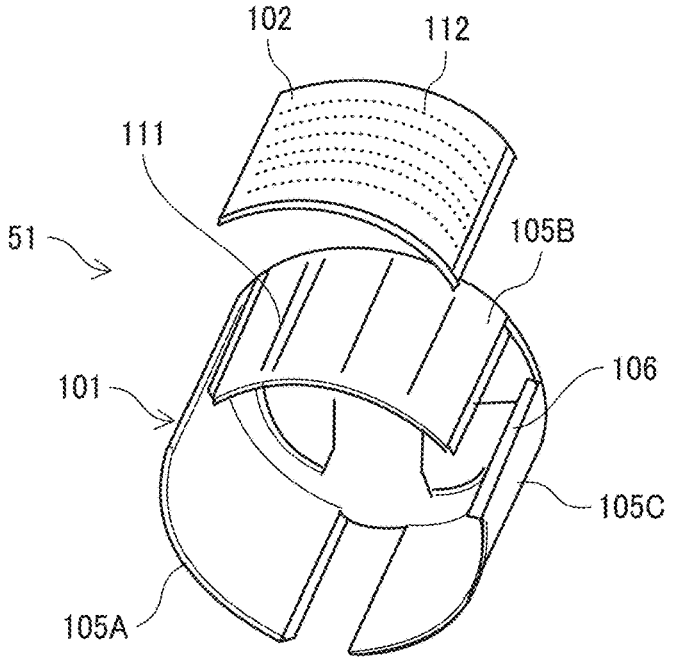
FIG. 4 is an exploded perspective view illustrating a drum.
Figure 5:
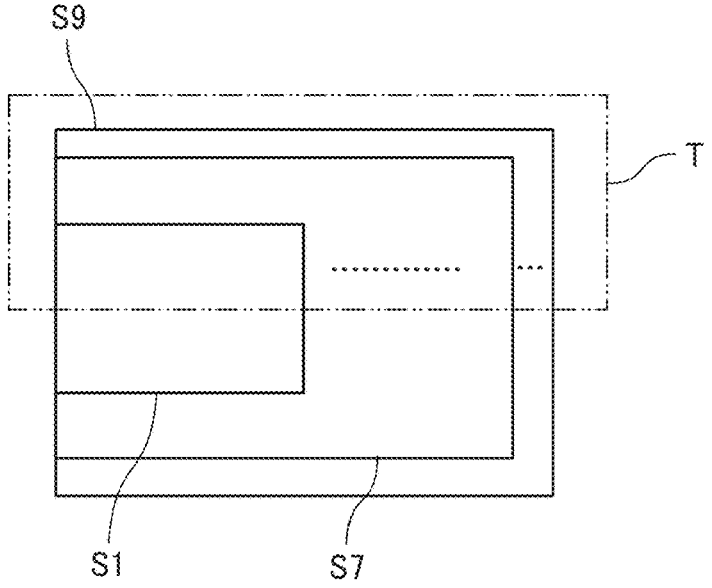
FIG. 5 is a plan view for explaining a sheet size in one carrying region of the drum of FIG. 4.
Figure 6:
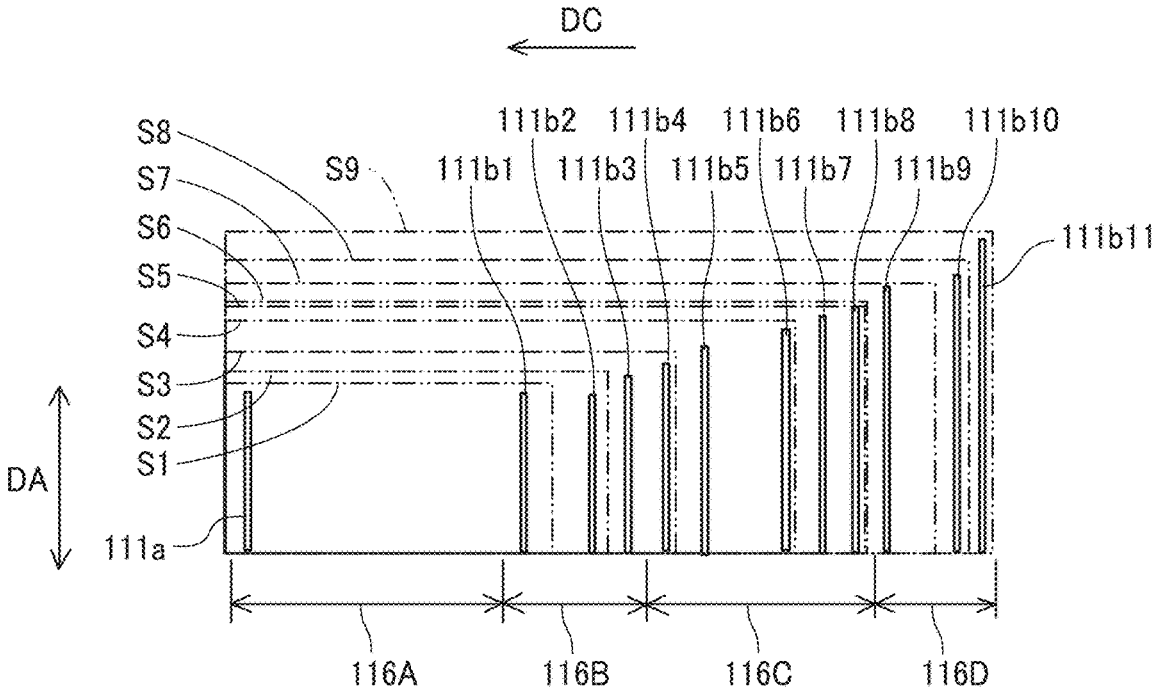
FIG. 6 is an enlarged view of an area T of FIG. 5, for explaining arrangement of air suction ports and the sheet size in a circumferential direction of the drum.
Figure 7:
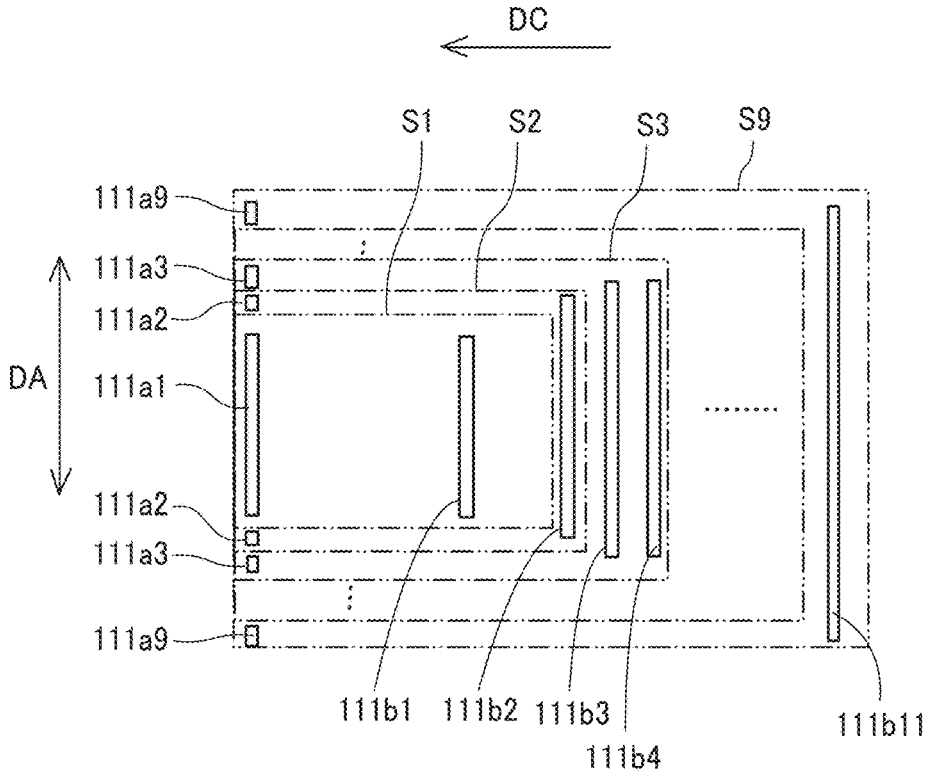
FIG. 7 is an enlarged view of a main part for explaining the arrangement of air suction ports in an axial direction of the drum and in a circumferential direction of the drum and the sheet size.
Figure 8:
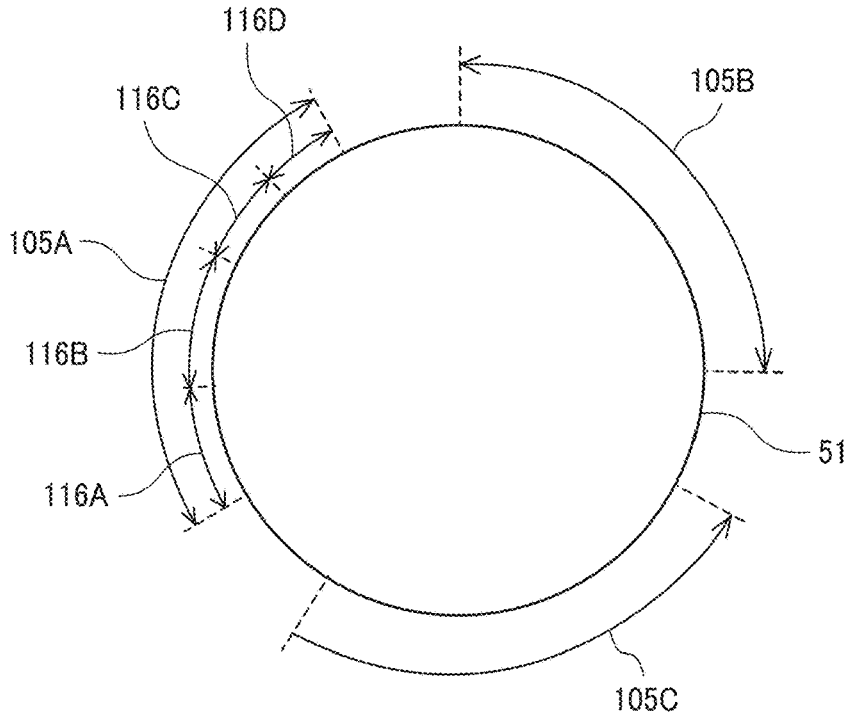
FIG. 8 is a side view illustrating the one carrying region of the drum and a divided region of the drum.

FIG. 4 is an exploded perspective view illustrating the drum, FIG. 5 is a plan view for explaining a sheet size in a carrying region of the drum of FIG. 4, and FIG. 6 is an enlarged view of an area T of FIG. 5 for explaining arrangement of suction ports in a circumferential direction of the drum and the sheet size. FIG. 7 is an enlarged view of a main part for explaining arrangement of suction ports in an axial direction of the drum and a circumferential direction of the drum, and the sheet size. FIG. 8 is a side view illustrating the carrying region of the drum and a divided region of the drum.

The drum 51 includes a drum body 101 and a suction plate 102. It is to be noted that a sealing material such as a rubber sheet may be interposed between the suction plate 102 and the drum body 101 of the drum 51.

The drum 51 has three carrying regions 105 (i.e., carrying regions 105A, 105B, and 105C), and carries a plurality of sheets P in the circumferential direction of the drum 51. As illustrated in FIG. 3, each of the carrying regions 105 includes the suction plate 102 and the drum body 101. The suction plate 102 has multiple suction holes 112 and forms a chamber 113 through which each of the multiple suction holes 112 communicates. The drum body 101 has multiple suction ports 111 of a groove shape that communicate with the chamber 113. Both the multiple suction holes 112 and the multiple suction ports 111 function as suction openings. It is to be noted that the sheet gripper 106 is disposed at the leading end of the carrying regions 105 in a direction of rotation of the drum 51. (The sheet gripper 106 is illustrated in a simplified manner in FIG. 4.)

As illustrated in FIGS. 5 and 6, sheet size areas S1 to S9 corresponding to a plurality of sheet sizes (in the present embodiment, 9 sheet sizes) are allocated to each of the carrying regions 105, and 12 suction ports 111*a* and 111*b*1 to 111*b*11 are arranged in the circumferential direction of the drum 51. Here, as illustrated in FIG. 7, the suction ports 111*a*1 to 111*a*9 on the leading end side in direction of rotation of the drum 51 are arranged in the axial direction corresponding to the sheet size areas S1 to S9.

For example, the suction ports 111*a*1 and 111*b*1 that communicate with the chamber 113 facing the plurality of suction holes 112 are arranged corresponding to the sheet size area S1. The suction ports 111*a*2 and 111*b*2 that communicate with the chamber 113 facing the plurality of suction holes 112 are arranged in the sheet size area S2 excluding the sheet size area S1 in the sheet area S2. The suction ports 111*a*3, 111*b*3, and 111*b*4 that communicate with the chamber 113 facing the plurality of suction holes 112 are arranged in the sheet size area excluding the sheet size areas S1 and S2 in the sheet area S3. The same arrangement is applied to the other sheet size areas S4 to S9.

In addition, as illustrated in FIG. 8, each of the carrying regions 105 is divided into four regions, which are a first region 116A, a second region 116B, a third region 116C, and a fourth region 116D, from the leading end in the rotational direction of the drum 51 in the circumferential direction (rotational direction) of the drum 51.

Here, as illustrated in FIG. 6, the first region 116A is assigned to the suction port 111*a* at the leading end in the direction of rotation of the drum 51, the second region 116B is assigned to the suction ports 111*b*1 to 111*b*3, the third region 116C is assigned to the suction ports 111*b*4 to 111*b*8, and the fourth region 116D is assigned to the suction ports 111*b*9 to 111*b*11.

Accordingly, a suction range of the carrying regions 105 of the drum 51 is switched by connecting the hose 56 to each suction port 111 (i.e., the suction ports 111*a* and 111*b*) on the drum 51 and switching the presence or absence of generation of negative pressure to each suction port 111 (i.e., the suction ports 111*a* and 111*b*).

Referring back to FIG. 3, the rotary valve 200 includes a fixed portion 201 and a rotating portion 202. The rotating portion 202 rotates together with the drum 51. The fixed portion 201 is connected to the suction unit 52 and is not rotated together with the drum 51.

Then, a communication state in which the suction holes 112 and the suction unit 52 communicate with each other and a non-communication state in which the suction holes 112 and the suction unit 52 do not communicate with each other are switched (changed) based on a relative phase difference between the rotating portion 202 and the fixed portion 201. In other words, the suction unit 52 sucks air via the suction holes 112. By so doing, the timing of generation of the negative pressure on the circumferential surface of the drum 51 is controlled. It is to be noted that a metal plate processed into a disk shape is commonly used for the rotating portion 202 and the fixed portion 201.

Next, a description is given of the rotary valve, with reference to FIGS. 9 to 15.

Figure 9:
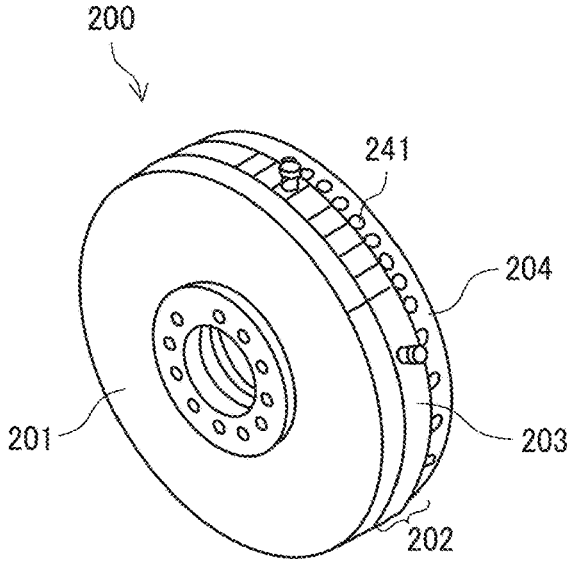
FIG. 9 is an external perspective view illustrating a rotary valve according to Embodiment 1 of this this disclosure.
Figure 10:
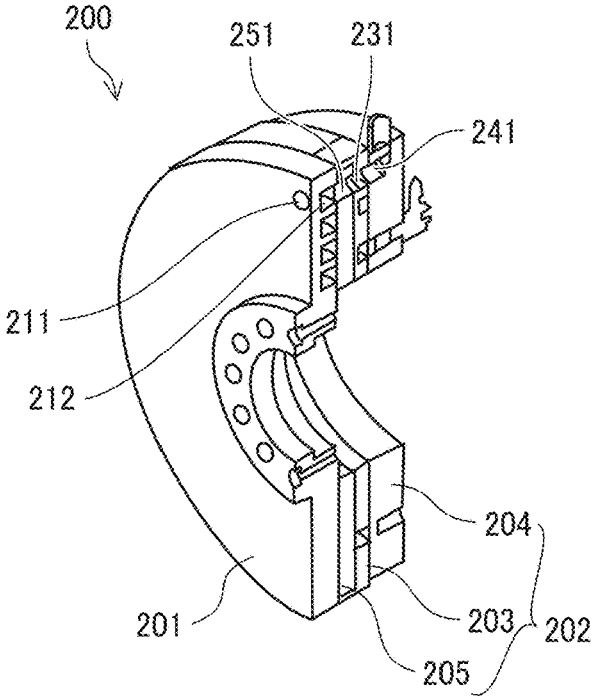
FIG. 10 is a semi-cross-sectional perspective view of the rotary valve of FIG. 9.
Figure 11:
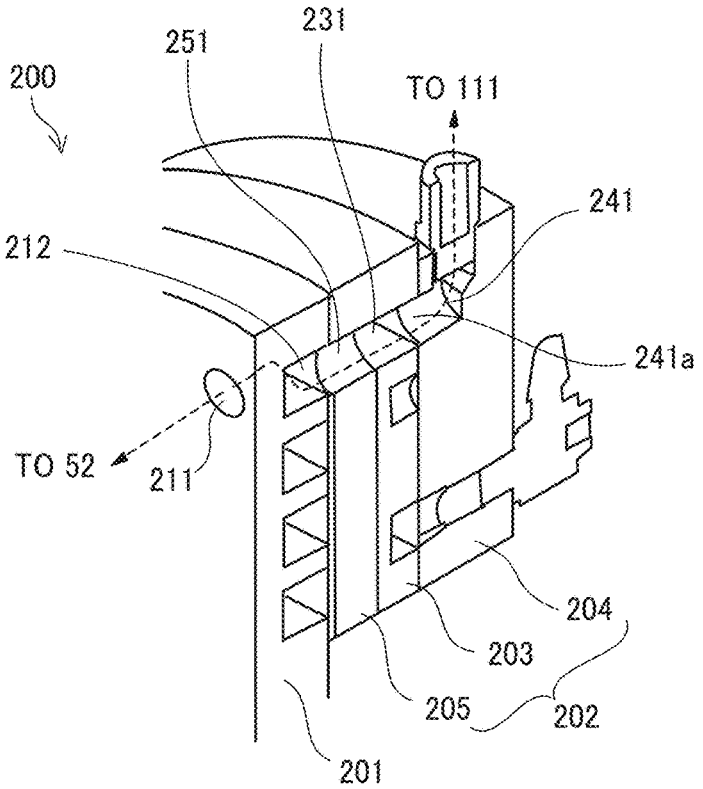
FIG. 11 is an enlarged cross-sectional perspective view of a main part of the rotary valve of FIG. 9.
Figure 12A:
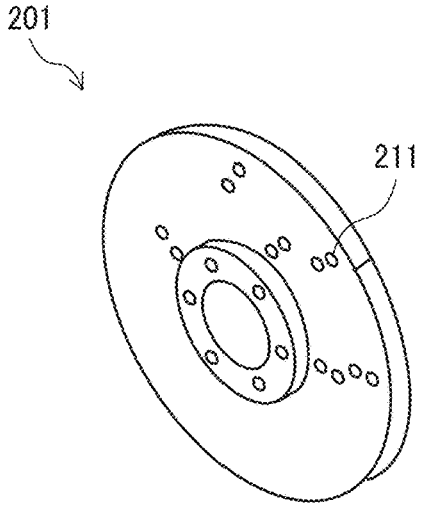
FIGS. 12A and 12B are perspective views illustrating a fixed portion of the rotary valve of FIG. 9.
Figure 12B:
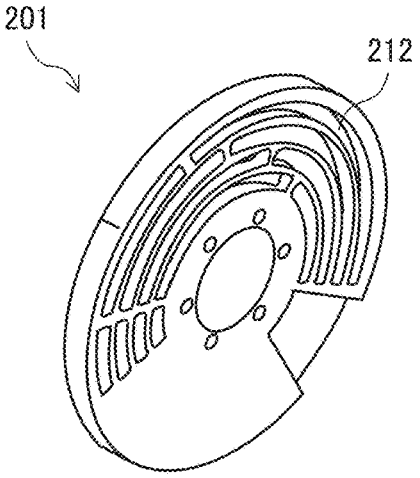
Figure 13:
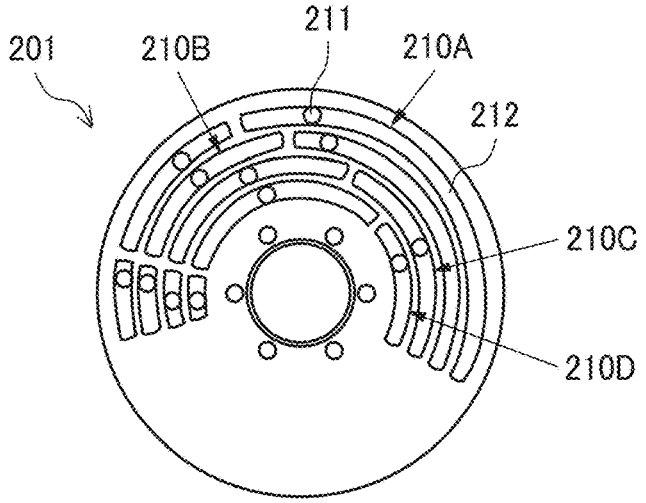
FIG. 13 is a side view illustrating the fixed portion of the rotary valve of FIG. 9.
Figure 14A:
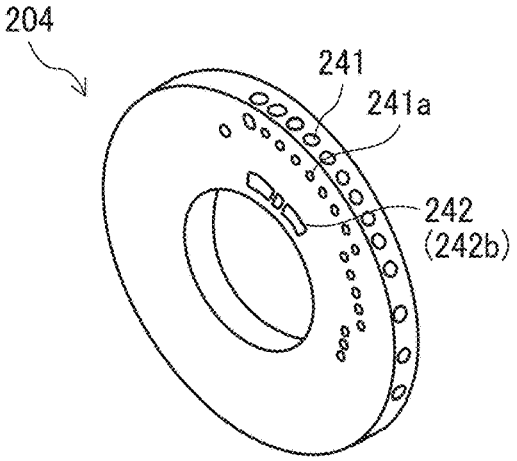
FIGS. 14A and 14B are perspective views illustrating a second member of the rotary valve of FIG. 9.
Figure 14B:
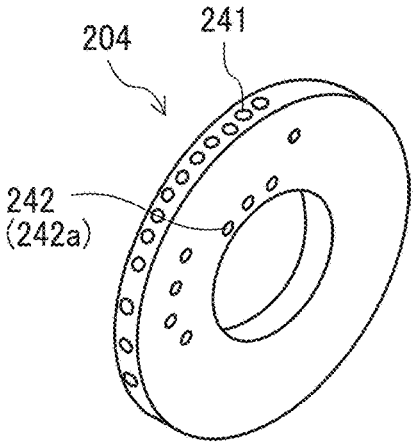
Figure 15:
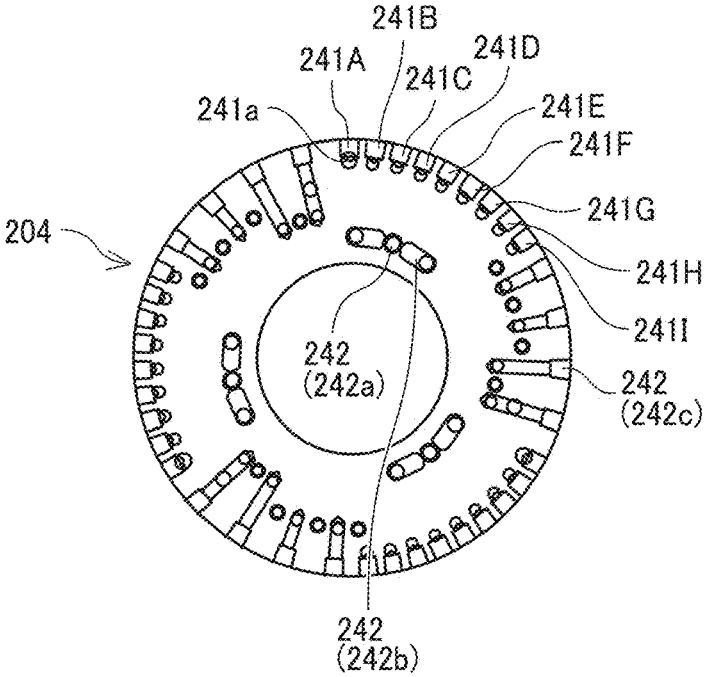
FIG. 15 is a side view illustrating the second member of the rotary valve of FIG. 9.
Figure 16A:
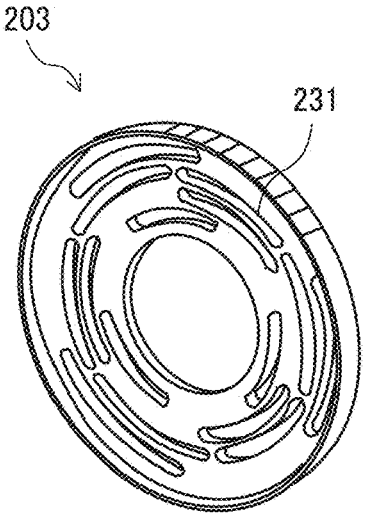
FIGS. 16A and 16B are perspective views of a first member of the rotary valve of FIG. 9.
Figure 16B:
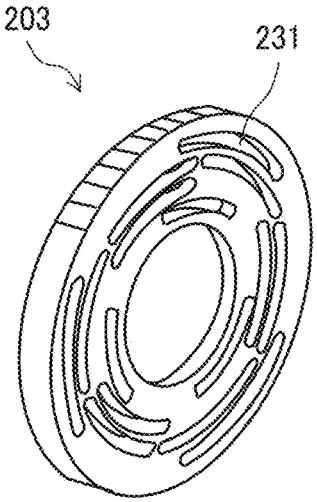
Figure 17:
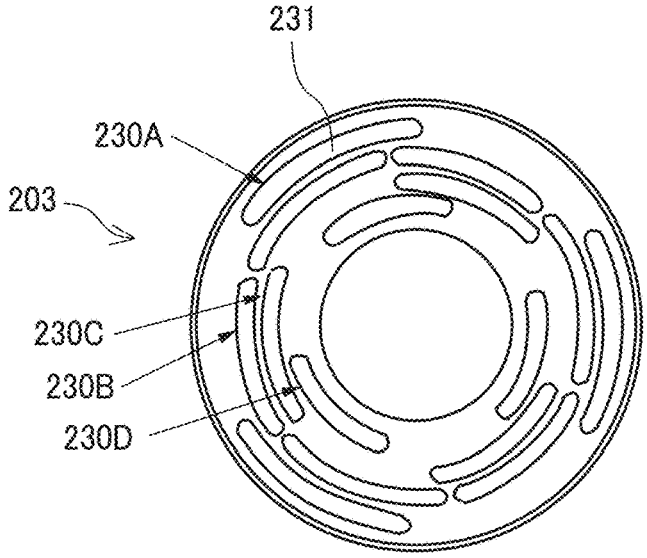
FIG. 17 is a side view illustrating the first member of the rotary valve.
Figure 18A:
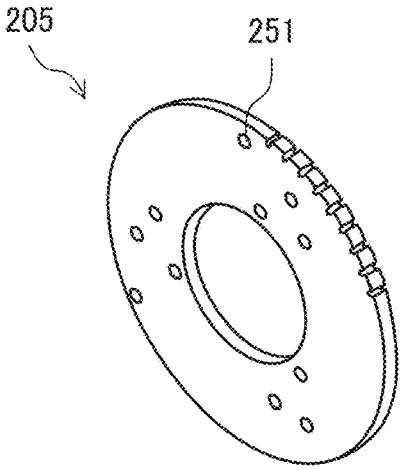
FIGS. 18A and 18B are perspective views illustrating a third member of the rotary valve.
Figure 18B:
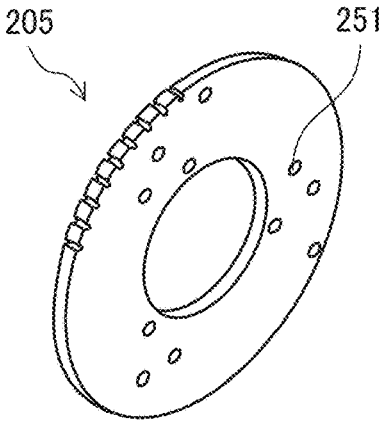
Figure 19:
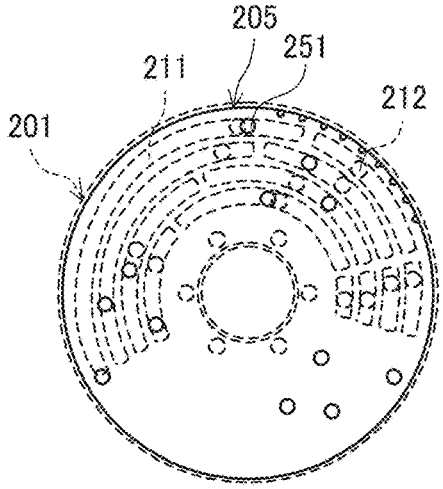
FIG. 19 is a side view illustrating the third member being overlaid on the fixed portion.

FIG. 9 is an external perspective view illustrating the rotary valve according to Embodiment 1 of this this disclosure. FIG. 10 is a semi-cross-sectional perspective view of the rotary valve of FIG. 9. FIG. 11 is an enlarged cross-sectional perspective view of a main part of the rotary valve of FIG. 9. FIGS. 12A and 12B are perspective views illustrating a fixed portion of the rotary valve. FIG. 13 is a side view illustrating the fixed portion of the rotary valve. FIGS. 14A and 14B are perspective views illustrating a second member of the rotary valve. FIG. 15 is a side view illustrating the second member of the rotary valve. FIGS. 16A and 16B are perspective views of a first member of the rotary valve. FIG. 17 is a side view illustrating the first member of the rotary valve. FIGS. 18A and 18B are perspective views illustrating a third member of the rotary valve. FIG. 19 is a side view illustrating the third member overlaid on the fixed portion.

It is to be noted that the fixed portion 201 of the rotary valve 200 is fixed to a frame 100 of the printer 1, as illustrated in FIG. 3. The frame 100 supports the drum 51, the transfer cylinder 24, and the discharging units 23.

The fixed portion 201 is disposed facing the rotating portion 202. The fixed portion 201 is provided with rows of a plurality of grooves 212 aligned in the radial direction of the fixed portion 201 and divided into three in the circumferential direction of the fixed portion 201, on the side where the fixed portion 201 slides on the rotating portion 202. Each groove 212 is provided with a through hole 211 and is connected to the suction unit 52. Here, the rows of the plurality of grooves 212 located on a concentric circle are referred to as groove row 210A, 210B, 210C, and 210D, respectively.

The rotating portion 202 of the rotary valve 200 includes a first member 203, a second member 204, and a third member 205. Each of the first member 203, the second member 204, and the third member 205 functions as a rotary body. The third member 205, the first member 203, and the second member 204 are disposed in this order of arrangement from the fixed portion 201 side. However, in the radial direction of the rotating portion 202 (i.e., the first member 203, the second member 204, and the third member 205), the first member 203 has a shape to cover the outer circumferential surface of the third member 205, and the third member 205 is fitted in the first member 203.

Holes 241 (here, nine (9) holes 241A to 241I) are openings provided on the circumferential surface of the second member 204 having the disk shape, in a circumferential surface of the second member 204. The holes 241 (i.e., the holes 241A to 241I) communicate with the suction ports 111 of the drum 51. Each of the holes 241 includes an opening 241*a* formed in the side face in contact with the first member 203. The nine holes 241A to 241I that are arranged (disposed) along in the circumferential direction of the second member 204 communicate with the nine suction ports 111*a* (i.e., the suction ports 111*a*1 to 111*a*9) in the axial direction of the drum 51, and are connectable to the plurality of suction holes 112, respectively.

The second member 204 having the disk shape further includes through holes 242*a* and grooves 242*b* on the side face and holes 242*c* on the circumferential surface. The through holes 242*a*, the grooves 242*b*, and the holes 242*c* are collectively referred to as "openings 242" or a "plurality of openings 242." The openings 242 are also connected to the suction ports 111.

It is to be noted that, as illustrated in FIG. 15, the plurality of holes 241 are provided corresponding to the carrying regions 105A, 105B, and 105C. However, the holes 241 for one of the carrying regions 105 are illustrated in a simplified manner in FIG. 14.

The first member 203 having the disk shape includes through grooves 231 that disposed extending on the circumferential surface along the circumferential direction. The through grooves 231 are provided on the side face, corresponding to the carrying regions 105. Here, the through grooves 231 are arranged at four positions concentrically in the radial direction from the outer circumferential side toward the center. The through grooves 231 located on the same concentric circle are referred to as groove rows 230A, 230B, 230C, and 230D.

The third member 205 having a disk shape includes a through hole 251 through which the plurality of grooves 212 of the fixed portion 201 and the through grooves 231 of the first member 203 communicate with each other.

The first member 203, the second member 204, and the third member 205 are included in the rotating portion 202, and rotate together with the drum 51 during sheet conveyance of the sheet P.

When switching the air suction region (air suction area), the first member 203 is rotated relative to the second member 204 and the third member 205. The second member 204 and the third member 205 are constantly rotated together. According to the rotation of the first member 203, the number of the holes 241 of the second member 204 that communicate with the through grooves 231 of the first member 203 is changed. Due to the change of the number of the holes 241 of the second member 204, a state of connection of the air suction passage changes, and the air suction region is switched (changed) and set according to the sheet size.

By contrast, in a comparative sheet conveying device, a switcher (switching valve) is opened and closed for each air suction area. Therefore, to perform this switching operation, the comparative sheet conveying device provides a configuration having a complicated design and increasing in size.

Figure 20:
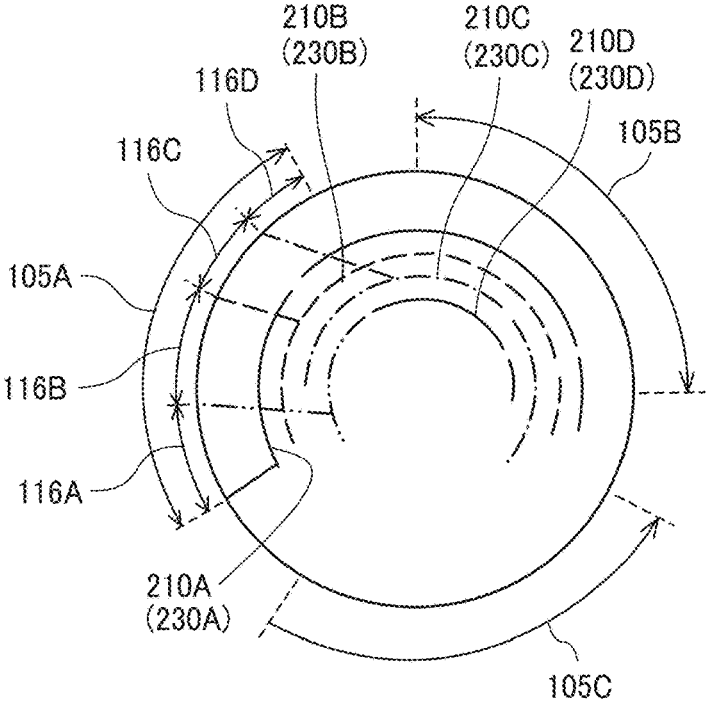
FIG. 20 is a diagram for explaining assignment of carrying regions and groove portions of the fixed portion.

Next, a description is given of the assignment of the carrying region and the grooves of the fixed portion, with reference to FIG. 20.

FIG. 20 is a diagram for explaining assignment of the carrying region and grooves of the fixed portion.

As described above, the drum 51 has the circumferential surface that is divided into three carrying regions 105 (i.e., the carrying regions 105A, 105B, and 105C). Each of the carrying regions 105 is divided into four regions, specifically, the first region 116A, the second region 116B, the third region 116C, and the fourth region 116D.

Then, the groove row 210A that is arranged on the outermost circumference of the fixed portion 201 is assigned to the first region 116A, so that the communication state and the non-communication state of each of the suction ports 111 of the first region 116A is switched (changed) by the groove rows 230A of the first member 203.

Further, the groove row 210D of the fixed portion 201 is assigned to the second region 116B, so that the communication state and the non-communication state of each of the suction ports 111 of the second region 116B is switched (changed) by the groove row 230D of the first member 203. Similarly, the groove row 210B of the fixed portion 201 is assigned to the third region 116C, so that the communication state and the non-communication state of each of the suction ports 111 of the third region 116C is switched (changed) by the groove row 230B of the first member 203. Furthermore, the groove row 210C of the fixed portion 201 is assigned to the fourth region 116D, so that the communication state and the non-communication state of each of the suction ports 111 of the fourth region 116D is switched (changed) by the groove row 230C of the first member 203.

Next, a description is given of switching of the air suction areas (switching of the sizes) based on the relative rotation of the first member and the second member, with reference to FIGS. 21A, 21B, 21C, 22A, 22B, and 22C.

Figure 21A:
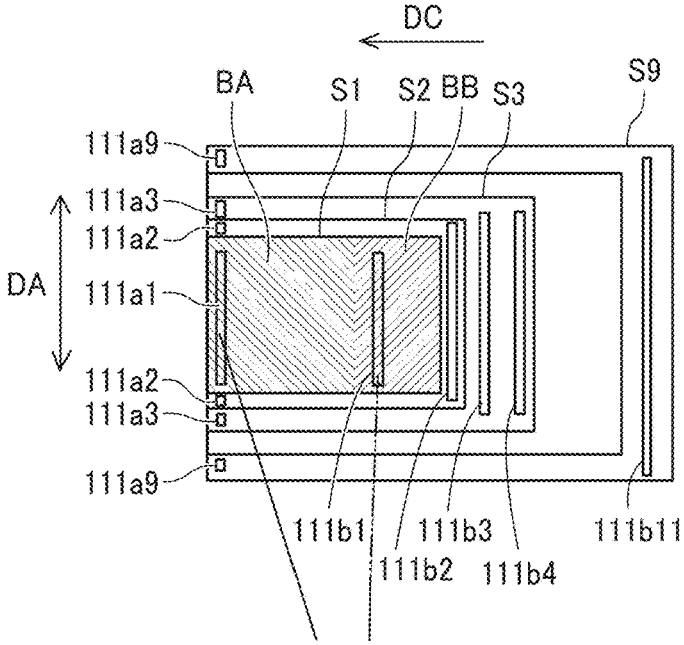
FIGS. 21A, 21B, and 21C are diagrams for explaining switching (size switching) of air suction areas (size switching) due to relative rotation of the first member and the second member.
Figure 21B:
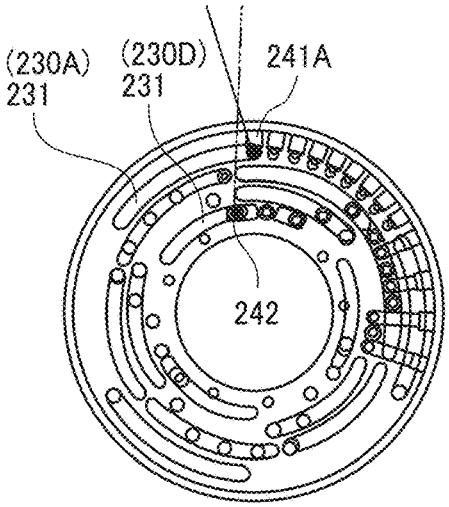
Figure 21C:
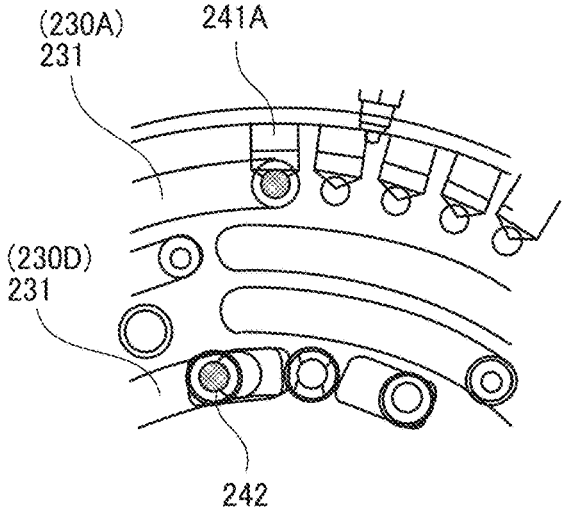
Figure 22A:
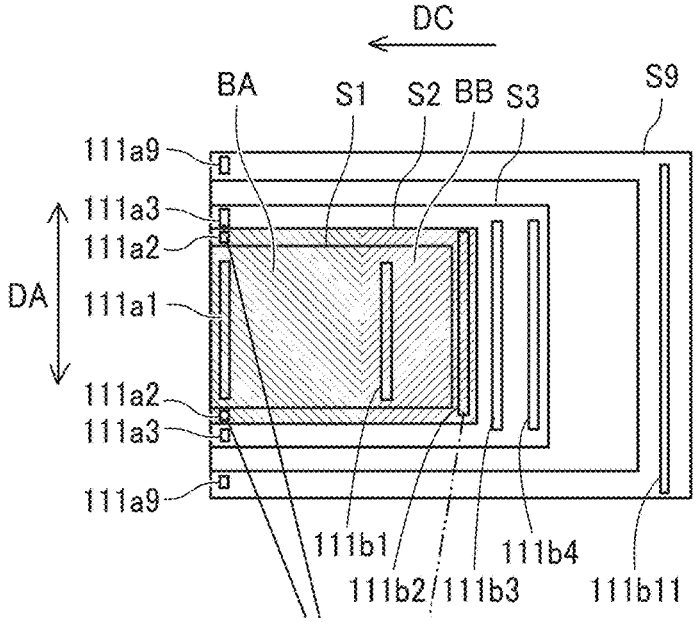
FIGS. 22A, 22B, and 22C are different diagrams for explaining switching (size switching) of air suction areas due to relative rotations of the first member and the second member.
Figure 22B:
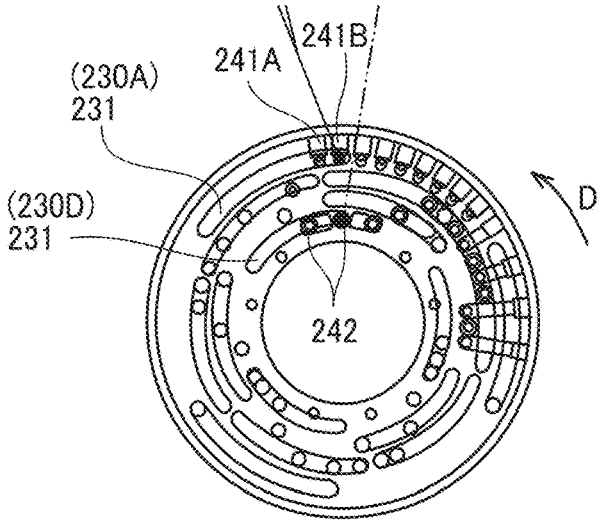
Figure 22C:
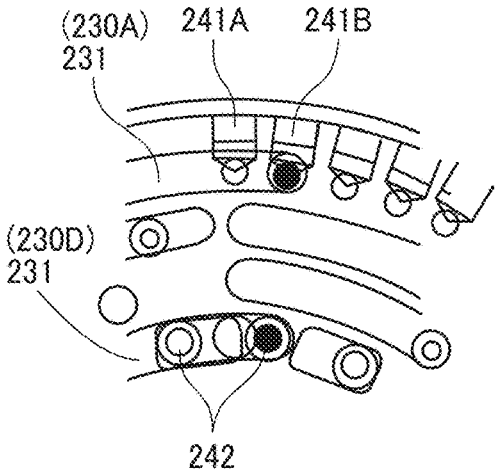

FIG. 21A is a diagram illustrating the sheet size on the drum and the suction ports of the drum, FIG. 21B is a side view illustrating the first member and the second member in a transmission state, and FIG. 21C is an enlarged view of the first member and the second member of FIG. 21B. Similarly, FIG. 22A is a diagram illustrating the sheet size on the drum and the suction ports of the drum, FIG. 22B is a side view illustrating the first member and the second member in a transmission state, and FIG. 22C is an enlarged view of the first member and the second member of FIG. 22B.

As described above, the nine (9) holes 241A to 241I arranged (disposed) along the circumferential direction of the second member 204 communicate with the nine (9) suction ports 111*a* (i.e., the suction ports 111*a*1 to 111*a*9).

Therefore, the size of the air suction region (air suction area) in the axial direction perpendicular to the circumferential direction of the drum 51 is switched (changed) by changing the number of suction ports 111*a* of the second member 204 that communicate with the through grooves 231 of the groove row 230A of the first member 203.

When the number of suction ports 111*a* of the second member 204 that communicate with the through grooves 231 of the first member 203 is switched (changed), the number of suction holes 112 facing the chamber 113 that communicates with the suction ports 111*a* is switched (changed).

The suction ports 111*b* (i.e., the suction ports 111*b*1 to 111*b*11) of the second member 204 communicates with any one of the groove rows 230B, 230C, and 230D of the first member 203.

Therefore, by switching the number of suction ports 111*b* (i.e., the suction ports 111*b*1 to 111*b*11) that passes via the openings 242 of the second member 204 communicating with the through grooves 231 of the groove rows 230B, 230C, and 230D of the first member 203, the size of the air suction area in the circumferential direction of the drum 51 is switched (changed).

When the number of suction ports 111*b* that communicate with the through grooves 231 of the first member 203 is switched (changed), the number of suction holes 112 facing the chamber 113 that communicates with the suction port 111*b* is switched (changed).

For example, as illustrated in FIGS. 21B and 21C, the relative positional relation between the first member 203 and the second member 204 is brought to a state in which the through grooves 231 of the groove row 230A of the first member 203 communicate with the hole 241A of the second member 204 and, at the same time, the through groove 231 of the groove row 230D of the first member 203 communicate with the openings 242 of the second member 204.

At this time, the suction unit 52 and the suction port 111*a*1 of the drum 51 come to a state in communication with each other, and the suction unit 52 and the suction port 111*b*1 of the drum 51 also come to a state in communication with each other.

As a result, as illustrated in FIG. 21A, air is sucked from the suction holes 112 provided to the region BA that communicates to the suction port 111*a*1 and the region BB that communicates to the suction port 111*b*1, and therefore the suction area of the sheet size area S1 is sucked by air.

From this state, for example, as illustrated in FIGS. 22B and 22C, the first member 203 is rotated in a direction indicated by arrow D with respect to the second member 204, so that the relative positional relation of the first member 203 and the second member 204 is brought into a state in which the through grooves 231 of the groove rows 230A of the first member 203 communicate with the holes 241A and 241B of the second member 204 and the through grooves 231 of the groove row 230D of the first member 203 communicate with the two openings 242 of the second member 204. It is to be noted that black dots illustrated in FIGS. 22B and 22C indicate portions that are to be communicated sequentially.

At this time, the suction unit 52 is communicated with the suction ports 111*a*1 and 111*a*2 of the drum 51 and the suction unit 52 is also communicated with the suction ports 111*b*1 and 111*b*2 of the drum 51.

As a result, as illustrated in FIG. 22A, air suction is conducted via the suction holes 112 provided to the region BA that communicates with the suction ports 111*a*1 and 111*a*2 and the region BB that communicates with the suction ports 111*b*1 and 111*b*2. Accordingly, the air suction area of the sheet size area S2 that is a subsequent sheet size area of the sheet size area S1 is sucked by air.

In the above-described configuration, as the first member 203 is rotated, the relative position of the first member 203 to the second member 204 is switched (changed) between stages, specifically, nine (9) stages. The transitions at nine (9) stages of the relative position of the first member 203 to the second member 204 are illustrated in FIGS. 23A through 25C.

Figure 23C:
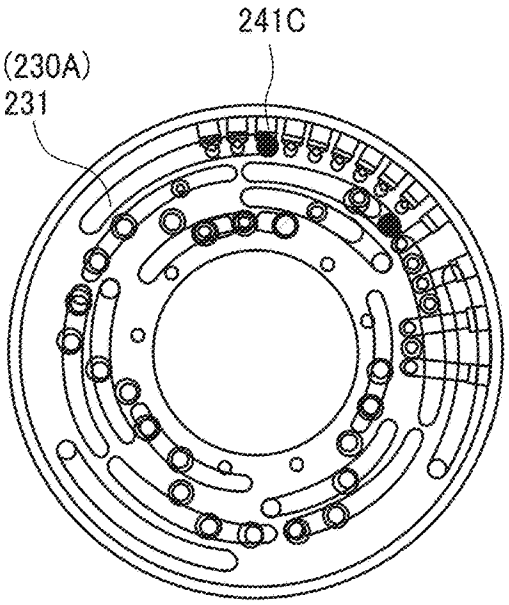
FIGS. 23A, 23B, and 23C are side views illustrating the first member and the second member in transmission states for explaining a transition state when switching the air suction areas into nine (9) stages.
Figure 23B:
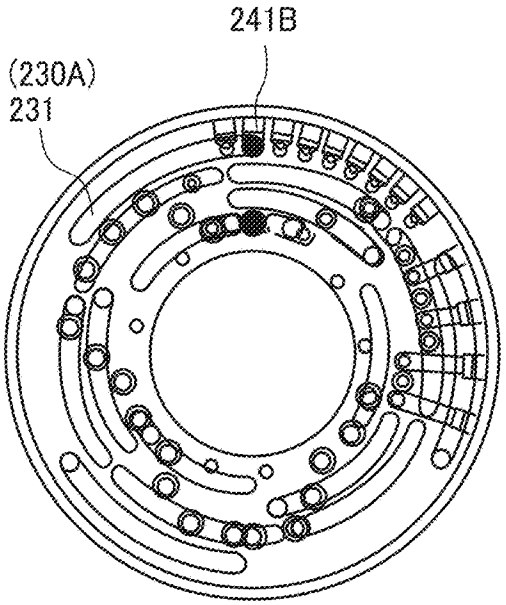
Figure 23A:
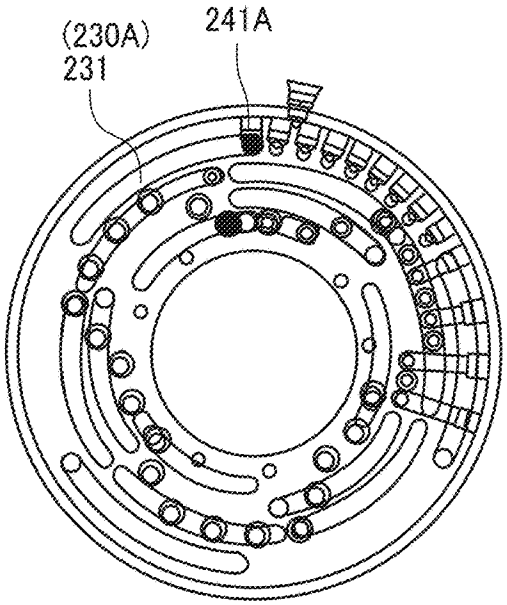
Figure 24C:
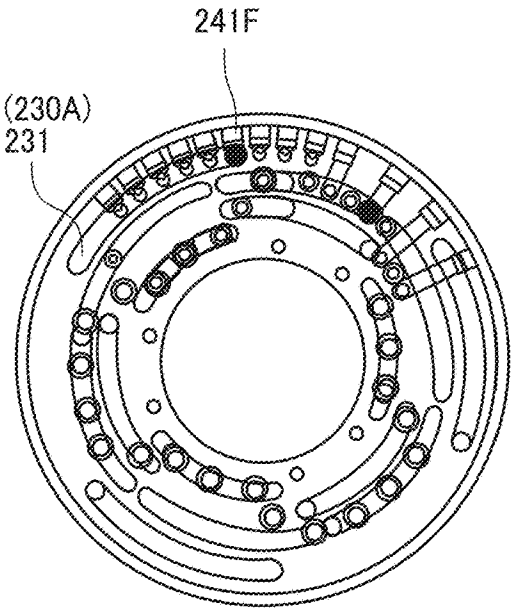
FIGS. 24A, 24B, and 24C are side views illustrating the first member and the second member in subsequent transmission states after FIGS. 23A, 23B, and 23C.
Figure 24B:
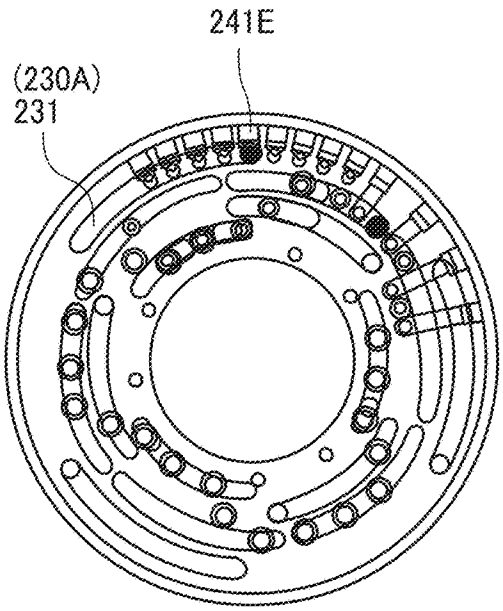
Figure 24A:
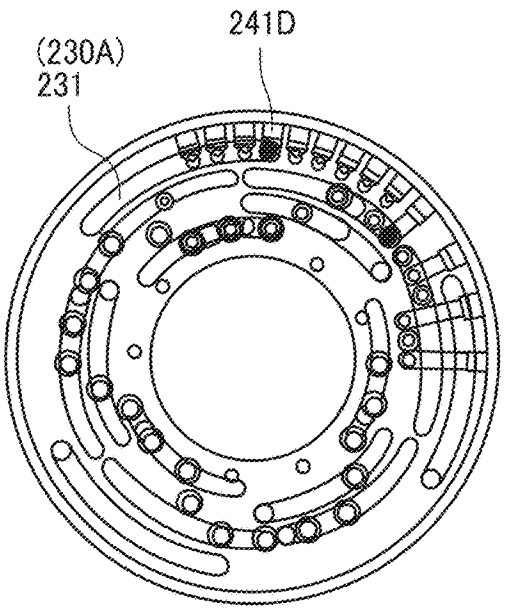
Figure 25C:
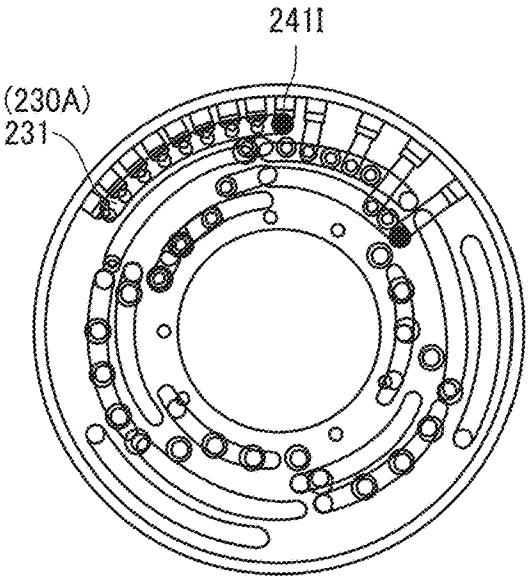
FIGS. 25A, 25B, and 25C are side views illustrating the first member and the second member in subsequent transmission states after FIGS. 24A, 24B, and 24C.
Figure 25B:
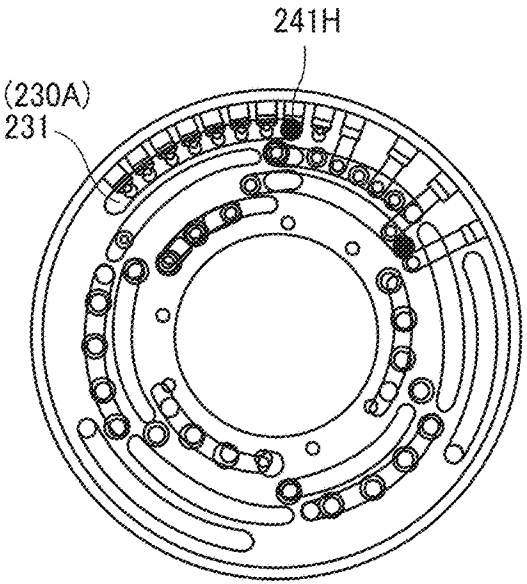
Figure 25A:
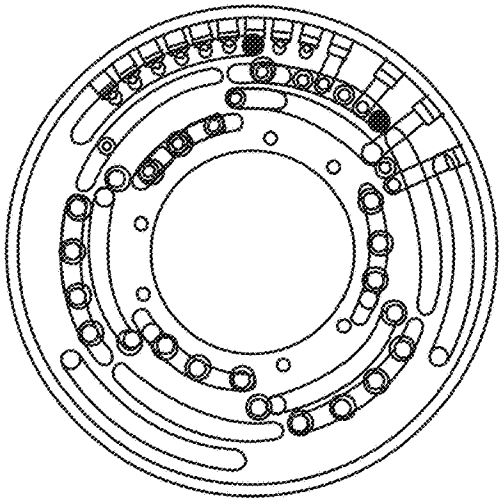

FIGS. 23A, 23B, and 23C are side views illustrating the first member 203 and the second member 204 in a transmission state for explaining a transition state when switching the suction areas into 9 stages. FIGS. 24A, 24B, and 24C are side views illustrating the first member 203 and the second member 204 in the transmission state after FIGS. 23A, 23B, and 23C. FIGS. 25A, 25B, and 25C are side views illustrating the first member 203 and the second member 204 in the transmission state after FIGS. 24A, 24B, and 24C. It is to be noted that FIG. 23A is illustrated at the same position as FIG. 21B and FIG. 23B is illustrated at the same position as FIG. 22B.

The holes 241 and the openings 242 are arranged such that two or three holes communicate with one carrying region 105 of the drum 51 each time one stage is switched (changed) to another. In the present embodiment, since the drum 51 has the three carrying regions 105, six (6) or nine (9) of the holes 241 and the openings 242 communicate by rotation in one step of the first member 203.

It is to be noted that two (2) or three (3) holes of the holes 241 and the openings 242 is to be selected according to a desired configuration. For example, this disclosure is applied to a configuration in which three suction ports 111*b* are allocated to the groove row 230D that is disposed the innermost groove row, a configuration in which five suction ports 111*b* are allocated to the groove row 230C, a configuration in which two suction ports 111*b* are allocated to the groove row 230D that is disposed the innermost groove row, and a configuration in which five suction ports 111*b* are allocated to the groove row 230D.

Next, a description is given of the switching operation by the first member, with reference to FIG. 26 to FIG. 29.

Figure 26:
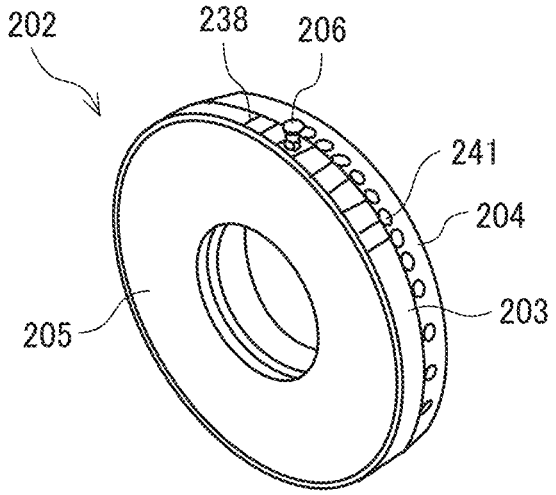
FIG. 26 is a perspective view illustrating a rotating portion of the rotary valve for explaining a switching operation performed by the first member.
Figure 27:
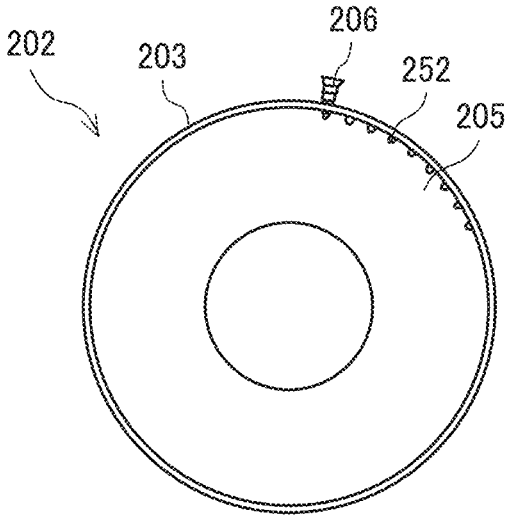
FIG. 27 is a side view illustrating the rotating portion of the rotary valve of FIG. 26.
Figure 28:
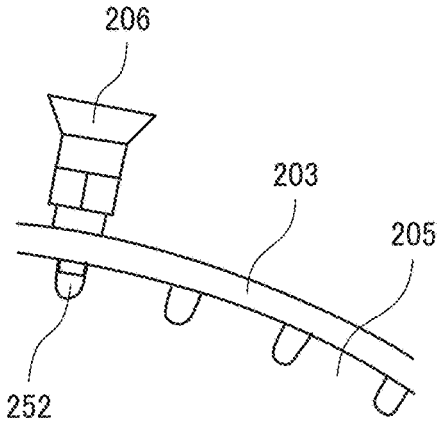
FIG. 28 is an enlarged side view illustrating the rotating portion of the rotary valve of FIG. 26.
Figure 29:
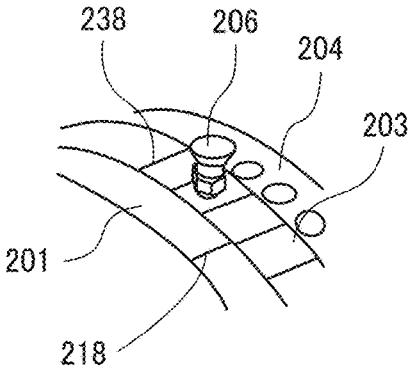
FIG. 29 is a perspective view illustrating a main part of the rotating portion of the rotary valve of FIG. 26.

FIG. 26 is a perspective view illustrating the rotating portion of the rotary valve for explaining the switching operation performed by the first member. FIG. 27 is a side view illustrating the rotating portion of the rotary valve of FIG. 26. FIG. 28 is an enlarged side view illustrating the rotating portion of the rotary valve of FIG. 26. FIG. 29 is a perspective view illustrating a main part of the rotating portion of the rotary valve of FIG. 26.

In the present embodiment, the first member 203 is rotated manually. In other words, a user manually rotates the first member 203. By rotating the first member 203 manually, an air suction area is switched to another air suction area. An index plunger 206 is used for the rotating operation (i.e., the air suction area switching operation) of the first member 203. The leading end of the index plunger 206 is fitted into one of holes 252 formed on the circumferential surface of the third member 205 according to each position. Accordingly, the positioning of the index plunger 206 is performed.

When rotating the first member 203, the index plunger 206 is pulled out from the one of the holes 252 to rotate the first member 203 relative to the second member 204 and the third member 205 to a target position. Then, at the target position, the leading end of the index plunger 206 is fitted into another one of the holes 252.

At this time, in order to cause the setting state of the first member 203 to be recognized, a scale 238 having nine (9) stages, for example, is disposed on the circumferential surface of the first member 203. The scale 238 functions as a position marker or a unit to indicate (display) the position of rotation of the first member 203.

Further, as illustrated in FIG. 29, a reference scale 218 that functions as a reference position marker with respect to the scale 238 of the first member 203 may be provided on the circumferential surface of the fixed portion 201.

It is to be noted that, in order to access the index plunger 206, a mode is fixed to a phase for switching the drum 51, for example, a "sheet size switching mode", so that the drum 51 is not rotated due to a force for operating the index plunger 206.

Figure 30:
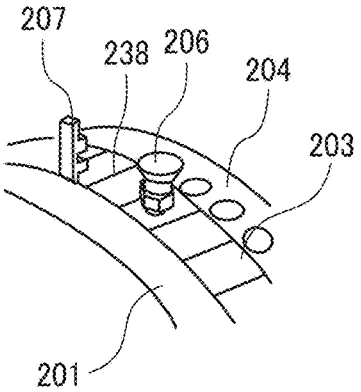
FIG. 30 is a perspective view illustrating a main part for explaining acquisition of size information of the air suction areas.

Next, a description is given of acquisition of size information of the air suction area, with reference to FIG. 30.

FIG. 30 is a perspective view illustrating a main part for explaining acquisition of size information of the air suction areas.

Here, a photosensor 207 is disposed on the fixed portion 201 that does not rotate with the drum 51, and a detection piece (feeler) that is detected by the photosensor 207 is provided to the first member 203. The photosensor 207 functions as a detector. As a result, since the first member 203 is rotated together with the drum 51, each time the drum 51 rotates by one rotation, the photosensor 207 detects the feeler to generate one pulse.

In a case in which the same mechanism as the above-described mechanism is provided to the drum 51, a total of two systems of pulses, which are one pulse generated by the filler provided to the drum 51 and one pulse generated by the filler provided to the first member 203, is obtained during one rotation of the drum 51.

Here, when focusing on the fact that the first member 203 has a phase difference with the second member 204 that rotates together with the drum 51, by measuring the interval between the pulse generated by the drum 51 rotating at a constant speed and the pulse generated by the first member 203 rotating at a constant speed, the angle of rotation of the first member 203 is detected. Therefore, the relative phase difference of the drum 51 and the first member 203, that is, the setting information of the air suction area, is obtained (acquired).

Next, a description is given of a configuration according to Embodiment 2 of this disclosure, with reference to FIGS. 31 to 35.

Figure 31:
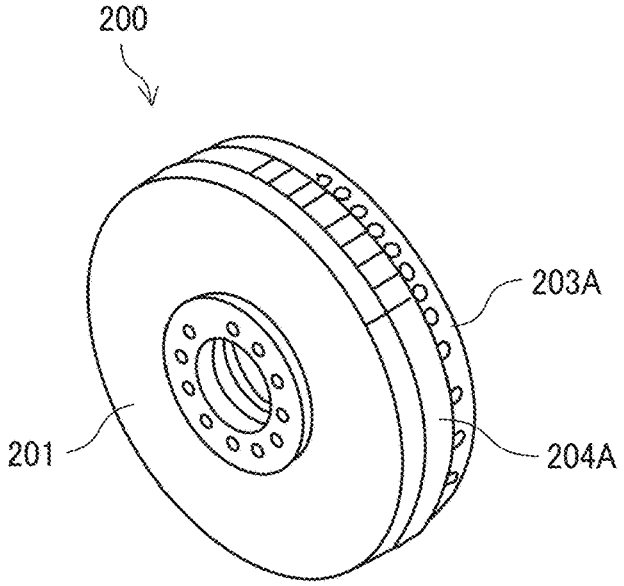
FIG. 31 is an external perspective view illustrating a rotary valve according to Embodiment 2 of this disclosure.
Figure 32:
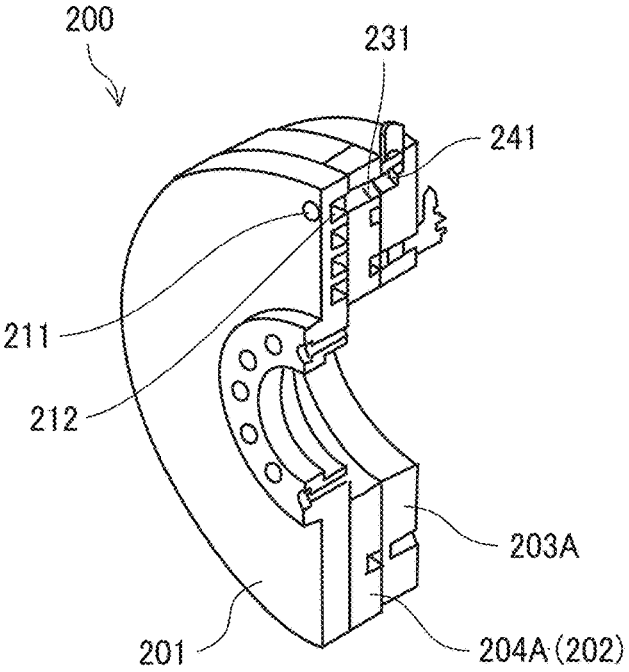
FIG. 32 is a semi-cross-sectional perspective view illustrating the rotary valve according to Embodiment 2 of this disclosure.
Figure 33:
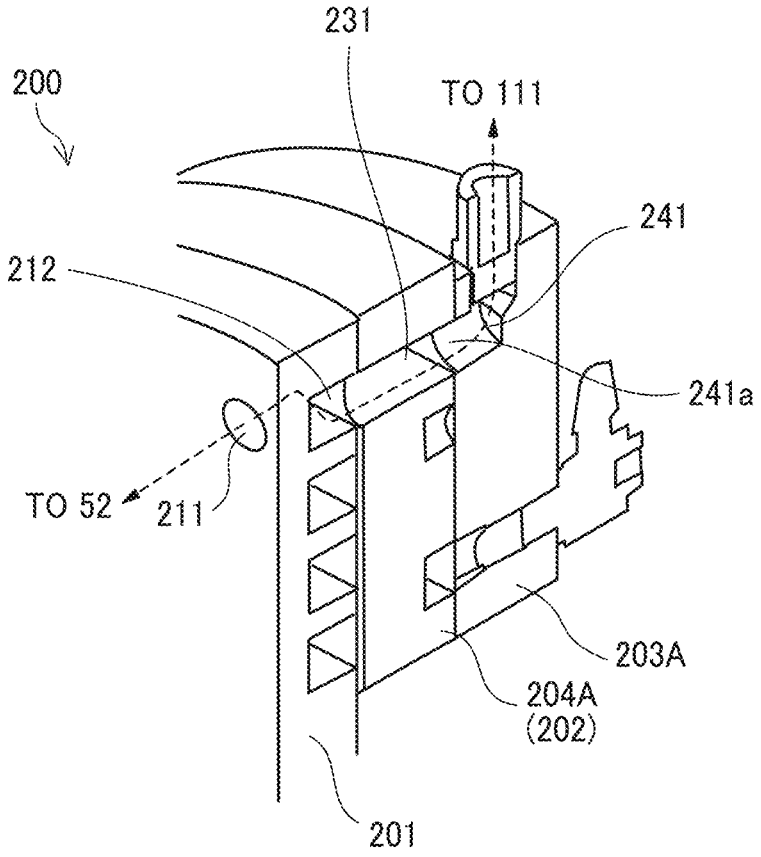
FIG. 33 is an enlarged perspective view illustrating a main part of the rotary valve according to Embodiment 2 of this disclosure.
Figure 34A:
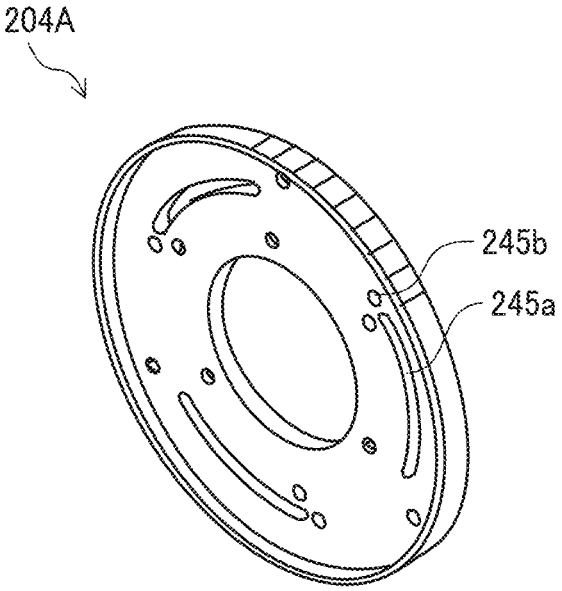
FIGS. 34A and 34B are perspective views illustrating a second member of the rotary valve according to Embodiment 2 of this disclosure.
Figure 34B:
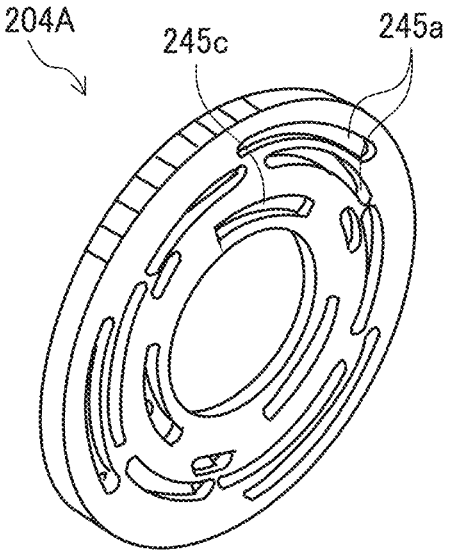
Figure 35:
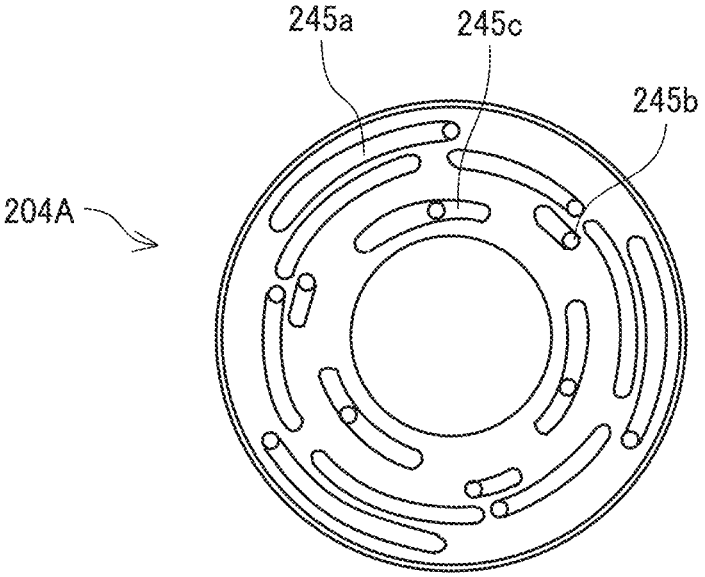
FIG. 35 is a side view illustrating the second member of the rotary valve according to Embodiment 2 of this disclosure.

FIG. 31 is an external perspective view illustrating a rotary valve according to Embodiment 2 of this disclosure. FIG. 32 is a semi-cross-sectional perspective view illustrating the rotary valve according to Embodiment 2. FIG. 33 is an enlarged perspective view illustrating a main part of the rotary valve according to Embodiment 2. FIGS. 34A and 34B are perspective views illustrating a second member of the rotary valve according to Embodiment 2. FIG. 35 is a side view illustrating the second member of the rotary valve according to Embodiment 2.

In the present embodiment, a first member 203A corresponds to the second member 204 of Embodiment 1 and a second member 204A corresponds to a member combining the first member 203 and the third member 205 of Embodiment 1. Each of the first member 203A and the second member 204A functions as a rotary body.

The second member 204A having a disk shape includes through grooves 245*a* arranged (disposed) along the circumferential direction of the second member 204A, groove portions 245*b* having respective bases, and through holes 245*c*, on the side face of the second member 204A. The through grooves 245*a*, the groove portions 245*b*, and the through holes 245*c* are disposed corresponding to the respective carrying regions 105. Here, the through grooves 245*a*, the groove portions 245*b*, and the through holes 245*c* are arranged concentrically at four positions from the outer circumference side toward the center in the radial direction of the second member 204A.

Accordingly, similar to Embodiment 1, in the configuration of Embodiment 2, by rotating the first member 203A relative to the second member 204A, the sizes of the air suction area (in other words, the number of suction holes 112 to be connected to the suction unit 52) is switched (changed).

In this case, the second member 204A is rotated together with the drum 51. Since the distance between the suction port 111 of the drum 51 and the connection port of the hose 56 of the rotating portion 202 of the rotary valve 200 varies according to the rotation of the first member 203A, the configuration of Embodiment 2 is a piping configuration that copes with the distance change.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the invention, and are included in the scope of the invention recited in the claims and its equivalent.

What is claimed is:

1. A sheet suction device comprising:

a sheet carrier having a carrying region, the carrying region including a plurality of suction openings, the sheet carrier being configured to rotate while holding a sheet;

a suction unit configured to communicate with the plurality of suction openings and suck air via the plurality of suction openings; and a rotary body disposed between the plurality of suction openings and the suction unit, the rotary body being configured to rotate together with the sheet carrier while holding a sheet, and to rotate relative to the sheet carrier to change a number of suction openings that communicate with the suction unit, among the plurality of suction openings of the sheet carrier, wherein the rotary body is configured to be rotated manually.

2. A sheet suction device of claim 1, further comprising:

another rotary body, including a plurality of openings that connect to the plurality of suction openings in the carrying region of the sheet carrier, wherein the plurality of openings of the another rotary body are disposed along a circumferential direction of the another rotary body, wherein the rotary body includes a groove, disposed along a circumferential direction of the rotary body and that communicates with the suction unit, wherein the rotary body is configured to rotate relative to the another rotary body to change a number of the plurality of openings of the another rotary body to be connected to the groove of the rotary body, and wherein, in response to a change of the number of the plurality of openings of the another rotary body, one or more suction openings that communicate with the suction unit, among the plurality of suction openings of the sheet carrier, is changed.

3. The sheet suction device of claim 2, wherein the rotary body and said another rotary body are configured to rotate together with the sheet carrier.

4. The sheet suction device of claim 1, further comprising:

another rotary body including a groove, disposed along a circumferential direction of the another rotary body and that communicates with the suction unit, wherein the rotary body includes a plurality of openings that connect to the plurality of suction openings in the carrying region of the sheet carrier, wherein the plurality of openings of the rotary body are disposed along a circumferential direction of the rotary body, wherein the rotary body is configured to rotate relative to the another rotary body to change a number of the plurality of openings of the rotary body to be connected to the groove of the another rotary body, and wherein, in response to a change of the number of the plurality of openings of the rotary body, the number of one or more suction openings that communicate with the suction unit, among the plurality of suction openings of the sheet carrier, is changed.

5. The sheet suction device of claim 4, wherein the another rotary body is configured to rotate together with the sheet carrier.

6. The sheet suction device of claim 1, further comprising:

a position marker, disposed on a circumferential surface of the rotary body and configured to indicate a position of rotation of the rotary body.

7. The sheet suction device of claim 1, further comprising:

a fixed portion disposed facing the rotary body and connected to the suction unit, and a detector disposed on the fixed portion, the detector configured to detect an angle of rotation of the rotary body.

8. The sheet suction device of claim 1, wherein the plurality of suction openings are disposed along a circumferential direction of the sheet carrier, and wherein, in response to a rotation of the rotary body, a number of one or more suction openings that communicate with the suction unit is changed in the circumferential direction of the sheet carrier.

9. The sheet suction device of claim 1, wherein the plurality of suction openings are disposed in an axial direction of the sheet carrier, and wherein, in response to a rotation of the rotary body, a number of one or more suction openings that communicate with the suction unit is changed in the axial direction of the sheet carrier.

10. A sheet conveying device, comprising:

the sheet suction device of claim 9, wherein the sheet carrier included in the sheet suction device is configured to rotate to convey the sheet while the sheet carrier holds the sheet on the sheet carrier.

11. A printer, comprising:

the sheet conveying device of claim 10.

12. A sheet conveying device, comprising:

the sheet suction device of claim 1, wherein the sheet carrier included in the sheet suction device is configured to rotate to convey the sheet while the sheet carrier holds the sheet on the sheet carrier.

13. A printer, comprising:

the sheet conveying device of claim 12.

14. A sheet suction device comprising:

a sheet carrier having a carrying region, the carrying region including a plurality of suction openings, the sheet carrier being configured to rotate while holding a sheet;

a suction unit configured to communicate with the plurality of suction openings and suck air via the plurality of suction openings; and a rotary body disposed between the plurality of suction openings and the suction unit, the rotary body being configured to rotate to change a number of suction openings that communicate with the suction unit, among the plurality of suction openings of the sheet carrier, wherein the sheet carrier is configured to hold a plurality of sheets on the sheet carrier in a circumferential direction of the sheet carrier.

15. A suction area switcher, comprising:

a first rotary body having a groove that is disposed along a circumferential direction of the first rotary body; and a second rotary body having a plurality of openings configured to connect to a plurality of suction openings in a carrying region on a sheet carrier that is configured to rotate while holding a sheet on the sheet carrier, the plurality of suction openings being disposed along a circumferential direction of the sheet carrier, wherein the first rotary body and the second rotary body are configured to be disposed between the sheet carrier and a suction device configured to communicate with the plurality of suction openings of the sheet carrier and suck air via the plurality of suction openings of the sheet carrier, wherein the first rotary body is configured to rotate relative to the second rotary body to change a number of the plurality of openings of the second rotary body to be connected to the groove of the first rotary body, and wherein, in response to a change of the number of the plurality of openings of the second rotary body, a number of one or more suction openings configured to communicate with the suction device, among the plurality of suction openings of the sheet carrier, is changed.

16. A sheet suction device, comprising:

the sheet carrier; and the suction area switcher of claim 15.

17. A sheet conveying device, comprising:

the sheet suction device of claim 16, wherein the sheet carrier included in the sheet suction device is configured to rotate to convey the sheet while the sheet carrier holds the sheet on the sheet carrier.

18. A printer, comprising:

the sheet conveying device of claim 17.

* * * * *